United States Patent [19]

Wassmer et al.

[11] Patent Number: 4,611,646

[45] Date of Patent: Sep. 16, 1986

[54] WORKPIECE-CENTERING TWO-SIDED PLANER

[75] Inventors: Paul Wassmer, Heitersheim; Fritz Schake, Bad Hersfeld, both of Fed. Rep. of Germany

[73] Assignee: Kupfermuhle Holztechnik GmbH, Hersfeld, Fed. Rep. of Germany

[21] Appl. No.: 607,613

[22] Filed: May 7, 1984

[30] Foreign Application Priority Data

May 7, 1983 [DE] Fed. Rep. of Germany ..... 3316857

[51] Int. Cl.[4] ..... B27C 1/08

[52] U.S. Cl. ..... 144/117 R; 144/242 R; 144/245 A; 198/627

[58] Field of Search ..... 144/116, 117 R, 242 R, 144/245 A; 198/627, 628

[56] References Cited

U.S. PATENT DOCUMENTS

| | | | |
|---|---|---|---|
| 2,664,927 | 1/1954 | Pierce | 144/242 R |
| 3,373,782 | 3/1968 | Pease | 144/116 |
| 4,457,350 | 7/1984 | Finnila | 144/117 R |

FOREIGN PATENT DOCUMENTS

| | | |
|---|---|---|
| 1987948 | 1/1968 | Fed. Rep. of Germany . |
| 32677 | 11/1964 | German Democratic Rep. . |

OTHER PUBLICATIONS

*Holz Lexicon,* (pp. 590 and 591) by Ewald König, published by DRW Verlag, Stuttgart, 1972.

*Primary Examiner*—Francis S. Husar

*Assistant Examiner*—Jorji M. Griffin

*Attorney, Agent, or Firm*—Karl F. Ross; Herbert Dubno

[57] ABSTRACT

An apparatus for planing opposite sides of a workpiece has a housing having a lower part and an upper part flanking a passage through which the workpiece to be planed is passed horizontally in a travel direction. Respective upper and lower planing drums rotatable on the respective housing parts above and below the passage about respective upper and lower axes extend transverse to the direction and define on rotation respective upper and lower cutting orbits centered on the respective axes. The lower drum is upstream of the upper drum relative to the workpiece travel direction. A stationary workpiece support table between the drums has an upper surface level and tangent with the lower orbit. Thus the underside of a workpiece passed in the direction over the lower drum is planed and slides downstream of the lower drum on the table surface. Respective upper and lower guide plates have vertically confronting faces upstream of the lower drum and are vertically displaceable on the respective housing parts between inner positions with the upper-plate face and lower plate-face level and tangent with the respective orbits and outer positions respectively vertically thereabove and therebelow. These upper and lower plates are interconnected and linked for substantially synchronous and opposite displacement so that the plates are always equispaced from a horizontal plane extending horizontally in the direction and vertically equispaced from the upper and lower orbits.

11 Claims, 3 Drawing Figures

WORKPIECE-CENTERING TWO-SIDED PLANER

FIELD OF THE INVENTION

The present invention relates to a planing machine. More particularly this invention concerns an apparatus for planing opposite sides of a wood workpiece.

BACKGROUND OF THE INVENTION

A standard power planer has a drum that is rotated at high speed about a horizontal axis and that carries a plurality of blades that themselves define a cutting orbit when the drum rotates. The apparatus further has a table that the drum projects up from so that the workpiece to be planed can be slid across the table, with the rotating drum cutting into and smoothing the workpiece. The part of the table downstream in the workpiece-travel direction from the blade is set to be level and tangent with the orbit of the drum, so that the planed surface of the workpiece will slide smoothly along it, whereas the upstream part of the table is set lower by a distance equal to the amount of material that is to be removed from the bottom side of the workpiece. Such an apparatus can effectively and rapidly smooth one side of the workpiece.

A two-sided planer is also known (See pp. 590ff of *Holz Lexicon* by Ewald Konig, published by DRW Verlag in Stuttgart, 1972.) which has two vertically spaced drums, the upper one rotating about an axis parallel to that of the lower one and being spaced downstream therefrom. The vertical position of the downstream drum can be adjusted to set the amount this drum planes off the upper side of the workpiece. A workpiece passed once through such a machine has its upper and lower sides both planed, establishing a set workpiece thickness. Such a machine is normally used to make finish-grade boards, and can even be set up with a second pair of cutter drums perpendicular to the first to plane and square the upright sides of the board also.

This type of multiside planer is extremely tedious to set up to produce a given board thickness. Normally the amount that is taken off the bottom side of the workpiece is always the same, and the upper cutter is set to take off the balance. Obviously this means that more is cut off one side of the board than the other. With such unequal planing the feed speed must be set in accordance with the amount being taken off on the side with the deeper cut, as travel speed must drop when a thick cut is being made if waviness is to be avoided and the tool to be preserved.

In general the operation of the known multiside planers is unsatisfactory in that feed speed must be held low for the reasons described above, the material of the workpiece is wasted, setup is very complex, and it is normally impossible to adjust thickness during a run. In fact any adjustment normally entails considerable down time for the machine.

OBJECTS OF THE INVENTION

It is therefore an object of the present invention to provide an improved two-sided planer.

Another object is the provision of such a two-sided planer that overcomes the above-given disadvantages, that is which automatically takes the same cut on opposite sides of the workpiece so that feed speed can be maximized and that also is relatively easy to set up.

SUMMARY OF THE INVENTION

An apparatus for planing opposite sides of a workpiece according to the invention has a housing having a lower part and an upper part flanking a passage through which the workpiece to be planed is passed horizontally in a travel direction. Respective upper and lower planing drums rotatable on the respective housing parts above and below the passage about respective upper and lower axes extend transverse to the direction and define on rotation respective upper and lower cutting orbits centered on the respective axes. The lower drum is upstream of the upper drum relative to the workpiece travel direction. A stationary workpiece support table between the drums has an upper surface level and tangent with the lower orbit. Thus the underside of a workpiece passed in the direction over the lower drum is planed and slides downstream of the lower drum on the table surface. Respective upper and lower guide plates have vertically confronting faces upstream of the lower drum and are vertically displaceable on the respective housing parts between inner positions with the upper-plate face and lower plate-face level and tangent with the respective orbits and outer positions respectively vertically thereabove and therebelow. These upper and lower plates are interconnected and linked for substantially synchronous and opposite displacement so that the plates are always equispaced from a horizontal plane extending horizontally in the direction and vertically equispaced from the upper and lower orbits. In addition the plates are biased into the inner positions.

With this arrangement, therefore, the same amount of material is planed off both sides of the workpiece, so that feed speed can be maximized and tool wear and so on will be perfectly uniform. In fact the planer can be fed miscellaneously sized workpieces, and will automatically plane them down to the desired side, determined by the vertical spacing of the drum axes. Even those workpieces that are only slightly thicker than is desired can be accurately planed on both faces.

The plates of the planer of this invention are interconnected by mechanism including respective upper and lower cranks pivoted on the housing parts, respective upper and lower frames pivoted on the cranks and carrying the plates, respective upper and lower hydraulic cylinders connected between the housing and the cranks, and hydraulic conduits interconnecting the cylinders for vertically synchronous and opposite movement of the plates. Normally two such upper and two such lower cranks and respective upper and lower links connecting the respective cranks for joint pivotal movement are provided, although other parallelogrammatic or wholly hydraulic systems are perfectly usable.

The interconnecting conduit between the hydraulic cylinders has a restriction for limiting flow between the cylinders. Thus the system will adjust slowly and smoothly to the workpiece.

The biasing arrangement of this invention includes a pneumatic cylinder braced via the link assembly on the plates. Appropriate adjustment of biasing pressure allows a board or similar workpiece that is corkscrewed to be fed to the planer accurately and in such a manner that it will exit the machine straight.

The apparatus of this invention is also provided with respective upper and lower transporters having respective upper and lower confronting workpiece gripping surfaces immediately upstream of the respective plate faces and advanceable in the travel direction for feeding the workpiece between the plates. The transport surfaces converge in the travel direction and have extreme downstream portions generally level with the respective plate faces. Thus the machine will be automatically self=feeding, and will be particularly effective in truing nonsquare or nonstraight workpieces.

The transporters of this invention each have at least one downstream wheel immediately adjacent the respective plate, at least one upstream wheel upstream from the respective downstream wheel and vertically offset therefrom away from the passage, and at least one respective endless traction element spanned between the respective wheels and having a stretch exposed in the passage and constituting the respective transport surface. Normally a plurality of wheels and elements are provided for best workpiece gripping. The elements are toothed or untoothed belts or may be elastomer-covered chains. The link assembly of such a device includes respective upper and lower frames pivotally mounted on the housing and carrying the respective plates and wheels. In this case respective upper and lower biasing plates are pivoted on the frames and engageable with the stretches of the endless elements and means is provided for pressing the biasing plates toward the passage and against the stretches with a predetermined force. In addition some sort of link is provided interconnecting the upper and lower biasing plates for substantially synchronously and oppositely displacing same.

The pressing or biasing means for the biasing plates according to this invention includes a fluid-cylinder assembly filled at least partially with a gas. The assembly can include at least one exclusively hydraulic cylinder, typically one for each biasing plate. The liquid in the system can be under a gas head that establishes the biasing pressure. It is also possible of course to use pneumatic cylinders for automatic equalization of the two biasing forces.

DESCRIPTION OF THE DRAWING

The above and other features and advantages will become more readily apparent from the following, in which:

FIG. 3 is a view corresponding to a detail of FIG. 2 but with the elements in a different operative position.

SPECIFIC DESCRIPTION

Figure 1:
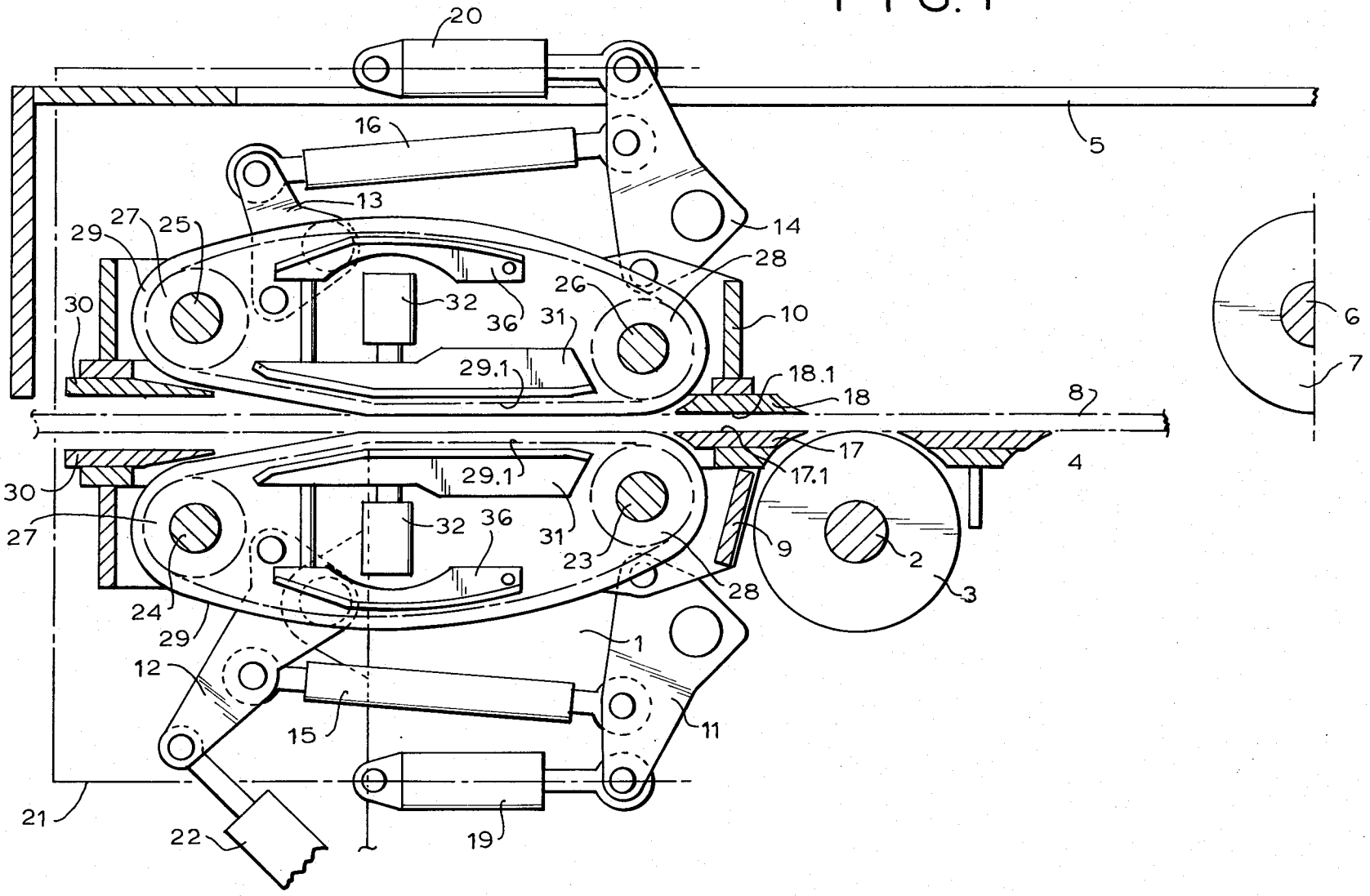
FIG. 1 is a partly schematic vertical section through the planer according to this invention.

As seen in FIG. 1 a top-and-bottom planer according to this invention has a housing with a lower part 1 and an upper part 5 together defining a horizontally throughgoing passage P extending in a feed or travel direction D. The lower housing part 1 is provided with a standard cylindrical cutter drum 3 carried on a shaft 2 centered on an axis 2A that extends horizontally but perpendicular to the direction D. This drum 3 is rotated by a motor indicated schematically at 38 so that its blades define an orbit O. Immediately downstream of the drum 3 the housing 1 has a table 4 whose upper surface 4.1 extends horizontally parallel to the direction D and tangent to the orbit O of the drum 3.

Downstream of the drum 3 the upper housing part 5 is provided with an upper drum 7 identical to the drum 3 and carried on a shaft 6 centered on and rotatable about an axis 6A parallel to but spaced vertically above the axis 2A. This drum 7 is also rotated at high speed about its axis 6A by the motor 38 and defines an orbit O spaced above the orbit O of the drum 3.

A workpiece shown schematically at W is passed in standard fashion along the passage P. Its bottom side will be planed off by the drum 3 and will ride downstream of the drum 3 on the surface 4.1 of the table 4. Further downstream the upper side of the workpiece W is similarly planed off by the drum 7.

According to this invention respective lower and upper frames 9 and 10 are provided in the housing parts 1 and 5 and carry respective plates 17 and 18 having planar faces 17.1 and 18.1 that are parallel and confront each other immediately upstream of the drum 2 and that extend parallel to the surface 4.1.

The frames 9 and 10 are carried on lower cranks 11, 12 and upper cranks 13, 14 pivotal about respective axes 11A–14A on the housing 1, 5. The distances between each of these axes 11A–14A and the point at which the respective crank 11–14 is pivoted on the frame 1 and 10 are all identical. In addition the lower cranks 11 and 12 are interconnected by an adjustable but rigid link 15 and the upper links are similarly interconnected by a link 16. The radius from each axis 11A–14A to the point where the respective end of the respective link 15 or 16 is pivoted on the respective crank 11–14 is the same, so that the two cranks of each frame 9 and 10 will move angularly synchronously and thereby displace the frames 9 and 10 vertically perpendicular to the always parallel surfaces 17.1, 18.1, and 4.1 as well as to the transport direction D.

In addition the identical cranks 11 and 14 have outer ends pivoted on piston rods of double-acting hydraulic cylinders 19 and 20 whose other ends are pivoted on the housing parts 1 and 5. These cylinders 19 and 20 are connected together as indicated schematically at 21 so that they will move the respective frames 9 and 10 vertically oppositely, that is if the plate 17 and the frame 9 is forced down the frame 10 will move correspondingly up, and vice versa. This is most easily done by connecting the compartments of the cylinders 19 front-to-back. A restriction 39 is provided in the conduits 21 to prevent the frames 9 and 10 from moving too rapidly.

Thus the two surfaces 17.1 and 18.1 will always be equispaced from a plane 8 that extends horizontally in the direction D and that itself is vertically equispaced between the two orbits O. These surfaces 17.1 and 18.1 can move from the illustrated inner positions in which they lie on planes tangent to the orbits O of the respective drums 7 and 3 to outer positions spaced therefrom, that is with the surface 17.1 lying below the orbit O of the drum 3 and the surface 18.1 lying above the orbit O of the drum 7. A biasing unit, here a pneumatic cylinder 22 is braced against one of the cranks, here the crank 12, to urge the plates 17 and 18 into the inner position. The biasing force exerted by this cylinder 22 can be adjusted and is normally sufficient to grip the board W solidly between the surfaces 17.1 and 18.1 as it passes through the passage P.

The lower frame 9 has a downstream shaft 23 and a lower upstream shaft 24, and the upper frame 10 similarly has a downstream shaft 26 and a higher upstream shaft 25. Seven respective upstream wheels 27 are provided on each of the upstream shafts 24 and 25 and seven identical downstream wheels or sprockets 28 are provided on the downstream shafts 23 and 26. An endless rubber-covered chain 29 is spanned between each upstream wheel 27 and the respective downstream wheel 8, so that it has a stretch 29.1 exposed in and in fact defining part of the passage P. These stretches 29.1 converge and the belts or chains 29 are driven by motors as illustrated schematically at 37 to advance in these stretches 29.1 in the travel direction D.

Thus it is possible to insert a workpiece or board W to be planed on its upper and lower surfaces between intake plates 30 of the frames 9 and 10. The leading end of the workpiece W will be gripped between the chains 29 and pulled in the direction D until it comes between the plates 17 and 18. These plates 17 and 18 will be pushed apart by the board W, all the time remaining equidistant from the plane 8, so that they will grip the board W tightly. First the lower side of the board w will be planed down by the drum 3 and then the upper surface by the drum 7, with the same amount of material being cut off both sides.

Figure 2:
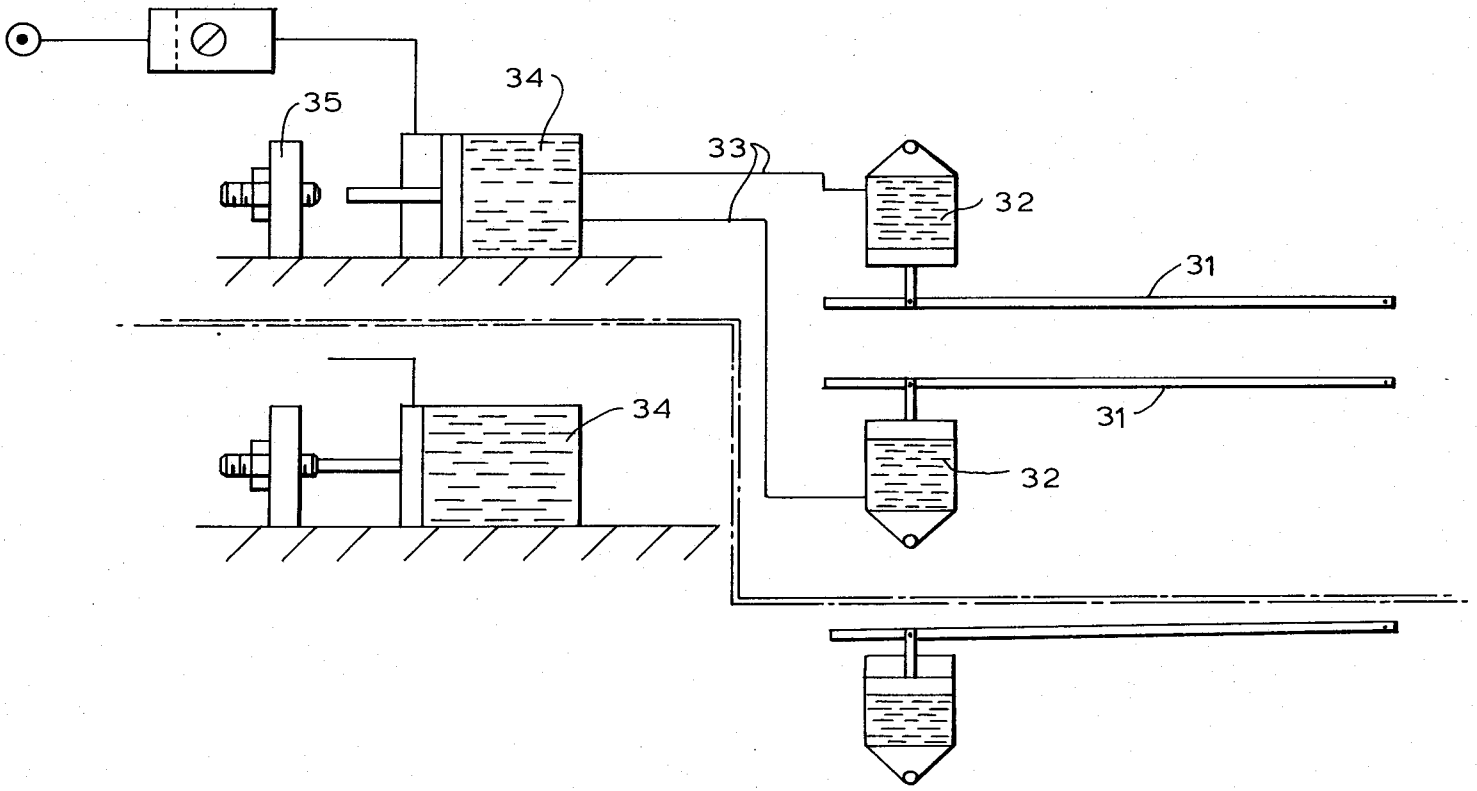
FIG. 2 is a mainly schematic view illustrating the operation of the apparatus of FIG. 1.

In addition each of the frames 9 and 10 is provided with a biasing shoe or plate 31 that is pivoted at one of its ends, here the downstream end and that is braced against a respective cylinder 32 that may be pneumatic, but that here are hydraulic and joined by lines 33 to a common cylinder 34 having a front compartment that is filled with liquid as shown in FIG. 2 and a rear compartment filled with air and connected to a supply 40 of air under constant pred with liquid as shown in FIG. 2 and a rear compartment filled with air and connected to a supply 40 of air under constant pressure. These shoes 31 are braced against the outer faces of the stretches 29.1 and therefore urge them inward against the workpiece with a predetermined pressure. Back shoes 36 are connected to the shoes 31 and are braced against the other stretches of the chains 29, being similarly pivotal about their downstream ends on the frames 9 and 10.

The cylinders 32 are connected together for joint and opposite movement of the shoes 31, like the movement of the frames 9 and 10. In addition a stop 35 is provided for the cylinder 34 so that when as shown in FIG. 3 the shoes 31 are pushed all the way into an extreme outer position further displacement is blocked. This protects the elements 29.

The system of this invention can even be adjusted as the board W is being cut. If the lumber is warped quite a bit, the pressure of the cylinder 22 as well as that of the cylinder 34 is increased. Similarly, if the exiting workpiece is too thick or too thin, it is possible to displace the upper drum 7 vertically, to which end a link is provided to the frames 9 and 10 to keep the plane 8 equidistant between these drums 3 and 7.

We claim:

1. An apparatus for planing opposite sides of a workpiece, the apparatus comprising:

a housing having a lower part and an upper part flanking a passage through which the workpiece to be planed is passed horizontally in a travel direction;

respective upper and lower planing drums rotatable on the respective housing parts above and below the passage about respective upper and lower axes extending transverse to the direction and defining on such rotation respective upper and lower cutting orbits centered on the respective axes, the lower drum being upstream of the upper drum relative to the workpiece travel direction, the lower drum being upstream relative to the travel direction from the upper drum;

a stationary workpiece support table between the drums and having a planar upper surface level and tangent with the lower orbit, whereby the lower side of a workpiece passed in the direction over the lower drum is planed and slides downstream of the lower drum on the table surface;

respective upper and lower guide plates having vertically confronting faces upstream of the lower drum and being vertically displaceable on the respective housing parts between inner positions with the upper-plate face and lower-plate face level and tangent with the respective orbits and outer positions respectively vertically thereabove and therebelow;

link means interconnecting the upper and lower plates for substantially synchronously and oppositely displacing the plates so that same are always equispaced from a horizontal plane extending horizontally in the direction and vertically equispaced from the upper and lower orbits;

biasing means connected to the plates for urging the plates into the inner positions; and respective upper and lower transport means each comprising a plurality of downstream wheels immediately adjacent the respective plate, respective upstream wheels upstream from the downstream wheels and vertically offset therefrom away from the passage, and respective endless traction elements spanned between the wheels and having respective stretches exposed in the passage, the stretches forming respective upper and lower confronting workpiece gripping surfaces immediately upstream of the respective plate faces and advanceable in the travel direction for feeding the workpiece between the plates, the transport surfaces converging in the travel direction and having extreme downstream portions generally level with the respective plate faces.

2. The two-sided planer defined in claim 7, further comprising means connected to the link means for vertically positioning the upper drum relative to the lower drum and simultaneously readjusting the plane so that same remains vertically equidistant between the orbits.

3. The two-sided planer defined in claim 7, wherein the link means comprises:

respective upper and lower cranks pivoted on the housing parts;

respective upper and lower frames pivoted on the cranks and carrying the plates;

respective upper and lower hydraulic cylinders connected between the housing and the cranks; and hydraulic conduit means interconnecting the cylinders for vertically synchronous and opposite movement of the plates.

4. The two-sided planer defined in claim 3 wherein the link means includes two such upper and lower cranks and upper and lower links connecting the respective cranks for joint pivotal movement.

5. The two-sided planer defined in claim 3, wherein the conduit means includes a restriction for limiting flow between the cylinders.

6. The two-sided planer defined in claim 7 wherein the biasing means includes a pneumatic cylinder braced via the link means on the plates.

7. The two-sided planer defined in claim 1, wherein the link means includes respective upper and lower frames pivotally mounted on the housing and carrying the respective plates and wheels.

8. The two-sided planer defined in claim 7, further comprising:

respective upper and lower biasing plates pivoted on the frames and engageable with the stretches of the endless elements; and means for pressing the biasing plates toward the passage and against the stretches with a predetermined force.

9. The two-sided planer defined in claim 8, further comprising link means interconnecting the upper and lower biasing plates for substantially synchronously and oppositely displaying same.

10. The two-sided planer defined in claim 8 wherein the means for pressing includes a fluid-cylinder assembly filled at least partially with a gas.

11. The two-sided planer defined in claim 10 wherein the assembly includes at least one exclusively hydraulic cylinder.

* * * * *